US009743465B2

(12) United States Patent
Mcspadden

(10) Patent No.: US 9,743,465 B2
(45) Date of Patent: Aug. 22, 2017

(54) MICROWAVE MODULE LID

(71) Applicant: Raytheon Company, Waltham, MA (US)

(72) Inventor: James Mcspadden, Waltham, MA (US)

(73) Assignee: Raytheon Company, Waltham, MA (US)

( * ) Notice: Subject to any disclaimer, the term of this patent is extended or adjusted under 35 U.S.C. 154(b) by 622 days.

(21) Appl. No.: 14/281,656

(22) Filed: May 19, 2014

(65) Prior Publication Data

US 2015/0334787 A1 Nov. 19, 2015

(51) Int. Cl.
*H05B 6/76* (2006.01)
*H05B 6/64* (2006.01)

(52) U.S. Cl.
CPC ..... *H05B 6/76* (2013.01); *Y10T 29/49828* (2015.01)

(58) Field of Classification Search
CPC ..... H05B 6/76; H05B 6/6402; H05B 6/64; Y10T 29/49828
USPC ..... 257/660, 708, 710, 704; 29/428; 219/738
See application file for complete search history.

(56) References Cited

U.S. PATENT DOCUMENTS 2,599,944 A 6/1952 Salisbury
5,324,887 A 6/1994 Catt et al.
5,832,598 A * 11/1998 Greenman ..... H01L 23/10 257/E23.114
6,060,342 A * 5/2000 Montauti ..... H01L 23/66 438/118
6,217,983 B1 4/2001 Alam et al.
6,358,361 B1 * 3/2002 Matsumoto ..... C23C 16/511 118/723 MW
8,013,775 B2 9/2011 Woods
2002/0008088 A1 * 1/2002 Suzuki ..... H01J 37/32238 219/121.41
2006/0066416 A1 * 3/2006 Nicholson ..... H01L 23/04 333/32
2010/0213584 A1 * 8/2010 Ju ..... H01L 23/055 257/660
2012/0067871 A1 * 3/2012 Sherrer ..... C23C 24/082 219/678

* cited by examiner

*Primary Examiner* — Alexander Oscar Williams

(57) ABSTRACT

A microwave module lid is disclosed. The microwave module lid can include an inner side operable to define, at least in part, a cavity configured to have a radio frequency (RF) emitting component disposed therein. The microwave module lid can also include two or more dielectric layers proximate one another. Each layer can have a thickness, a dielectric constant, and a dielectric loss characteristic. In addition, the microwave module lid can include a metal backing layer proximate one of the dielectric layers to contain RF energy within the lid. The thicknesses, the dielectric constants, and/or the dielectric loss characteristics of the dielectric layers can be configured to minimize RF resonance in the cavity.

20 Claims, 5 Drawing Sheets

MICROWAVE MODULE LID

BACKGROUND

Typical microwave components and subsystems comprise metal, or at least metal-coated, enclosures that form cavities for mounting monolithic microwave integrated circuits (MMIC) chips and other components, which can include amplifiers. These enclosures include lids that physically protect the MMIC chips, wire-bonds, and other components from damage in manufacture and use and from the external environment. The lids also protect the components from interference caused by electromagnetic radiation from the electronics in the rest of the system and the operating environment.

Microwave circuits typically radiate energy, such as from interconnect tracks, bond wires, and/or the chips themselves. At certain frequencies, the energy can dominate the functionality and destroy performance of the chips. For example, radiated energy can couple into other parts of the circuit and can often cause unwanted or catastrophic behavior, such as resonance in the "cavity" that houses the MMIC chips. Resonances often cause amplifiers to oscillate, which can render a microwave module completely non-functional. The ease with which unwanted radiation "leaks" into and affects all parts of a system presents a substantial challenge. A typical approach to managing these problems is to package microwave chips with radiation-absorbent material, such as a thin sheet of radiation-absorbent material attached to an underside of a module's lid, or metal or dielectric posts located inside a module to suppress cavity resonances and stray radiation coupling.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
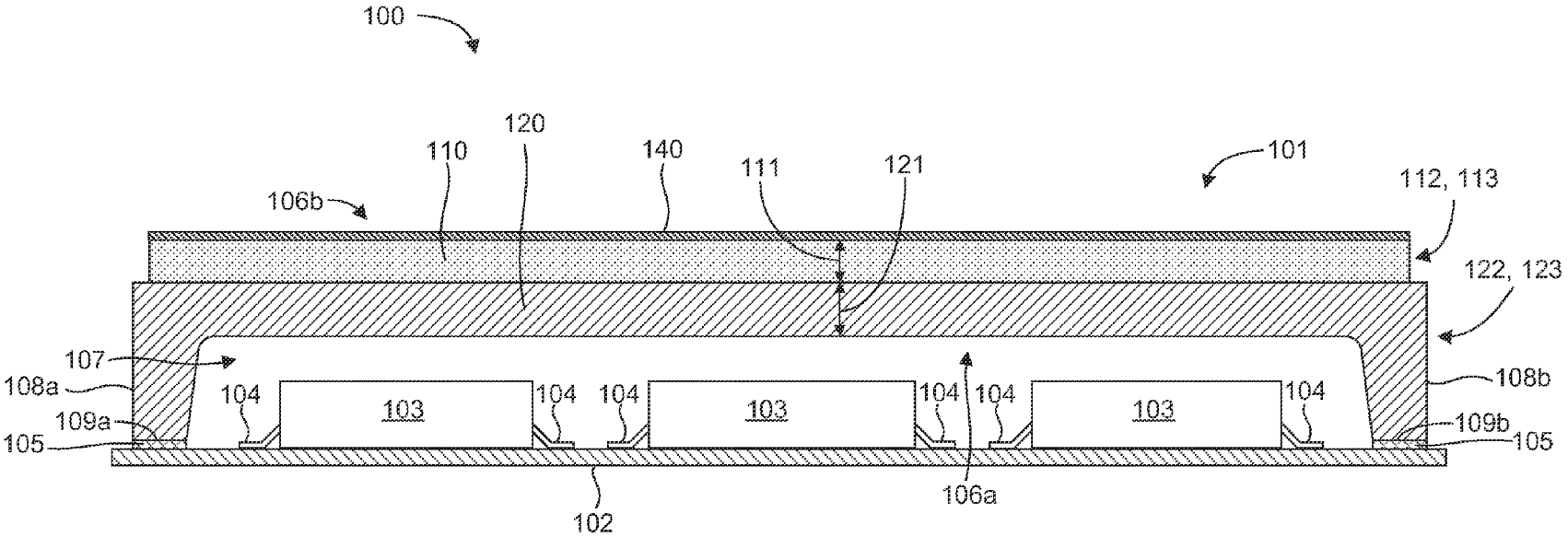
FIG. 1 is an example illustration of a microwave module in accordance with an example of the present disclosure.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

Although typical solutions for dealing with cavity resonance have been effective in some situations, these solutions may be almost completely ineffective in many other situations. For example, when the gain of a radio frequency (RF) emitting chain of amplifiers in a small space is high (i.e., between about 20 dB and about 30 dB) or very high (i.e., greater than about 30 dB), the typical metal lid with a layer of absorber is not likely to reduce feedback/resonances to a level that avoids oscillations, particularly in small cavities. Thus, there is a need for an effective solution that provides stability for high gain modules.

Accordingly, a microwave module lid is disclosed that suppresses feedback that leads to oscillatory conditions for high gain modules. In one aspect, the lid is effective for high gain modules that are confined in a small cavity. The microwave module lid can include an inner side operable to define, at least in part, a cavity configured to have an RF emitting component disposed therein. The microwave module lid can also include at least two dielectric layers proximate one another. Each layer can have a thickness, a dielectric constant, and a dielectric loss characteristic. In addition, the microwave module lid can include a metal backing layer proximate one of the dielectric layers to contain RF energy within the microwave module lid. The thicknesses, the dielectric constants, the dielectric loss characteristics, or combinations thereof of the at least two dielectric layers can be configured to minimize RF resonance in the cavity.

In another aspect, a microwave module is disclosed. The microwave module can include a substrate, a RF emitting component disposed on the substrate, and a lid coupled to the substrate. The lid can include an inner side operable with the substrate to define a cavity about the RF emitting component. The lid can also include at least two dielectric layers proximate one another. Each layer can have a thickness, a dielectric constant, and a dielectric loss characteristic. In addition, the lid can include a metal backing layer proximate one of the dielectric layers to contain RF energy within the lid. The thicknesses, the dielectric constants, the dielectric loss characteristics, or combinations thereof of the at least two dielectric layers can be configured to minimize RF resonance in the cavity.

One example of a microwave module 100 is illustrated in FIG. 1. The microwave module 100 can comprise a substrate 102 and one or more circuit components 103 disposed on the substrate 102. The circuit components 103 can comprise a MMIC chip or any other type of circuit component that may be used in a microwave module. Wire bonds 104 may be used to couple the circuit component 103 to metal traces in the microwave module 100, which can be disposed on or in the substrate 102. In many cases, the wire bonds 104 and/or the circuit components 103 may be fragile and easily damaged. Therefore, the microwave module 100 can also include a microwave module lid 101 coupled to the substrate 102 to shield and/or protect the circuit components 103 and the wire bonds 104 from particles and debris that can be detrimental to performance. The lid 101 can have an inner side 106*a* that, along with the substrate 102, defines or forms a cavity 107 about the circuit components 103 and the wire bonds 104. In general, an epoxy 105 may be used to couple the lid 101 to the substrate 102. In cases where a hermetic seal is needed about the cavity 107, the lid 101 can be coupled to the substrate 102 via solder, or solder may be used to seal around the lid 101.

It is common for the wire bonds 104 and/or circuit components 103 to emit "stray" RF radiation. Prior microwave modules typically use a metallic lid to shield and/or protect the circuit components 103 and the wire bonds 104. In this type of microwave module, instabilities due to microwave energy reflected back from the lid to the input of the device can create a feedback path that can cause the amplitude to oscillate. For example, a typical metallic lid can create resonances and feedback paths in the cavity that can cause problems for circuit components, such as causing amplifiers to oscillate and/or have ripple in their pass band characteristics. Resonances and feedback can be particularly prominent in a small cavity where space inside the cavity 107 has been minimized around the circuit components 103 and the wire bonds 104. Thus, the presence of the metallic lid can make it difficult to keep the microwave module stable when there is a lot of RF gain inside the module because only a small amount of feedback is needed to induce oscillations due to radiated RF energy looping back to the input of an amplifier.

To minimize or eliminate problems such as these that arise when using a lid, the lid 101 can include dielectric layers 110, 120 proximate one another to absorb RF energy. In addition, the lid 101 can include a metal backing layer 140 proximate the dielectric layer 110 to provide a reflecting plane and contain RF energy within the lid 101. In one aspect, the dielectric layers 110, 120 can define, at least in part, the inner side 106*a* of the lid 101. In another aspect, the metal backing layer 140 can define, at least in part, an outer side 106*b* of the lid 101. Each dielectric layer 110, 120 can have a thickness 111, 121, respectively, a dielectric constant 112, 122, respectively, and a dielectric loss characteristic 113, 123, respectively, which can be tuned or configured individually or in any combination to minimize RF resonance in the cavity 107. For example, the thickness 111, 121 of the dielectric layers 110, 120, respectively, can vary for tuning absorption to a desired frequency band (i.e., 15-18 GHz). The materials of the dielectric layers 110, 120 can be selected with appropriate dielectric constants 112, 122, and dielectric loss characteristics 113, 123. In one aspect, a dielectric constant can be selected for a particular frequency range. In some example lids, the thickness 111, 121 and the dielectric constant 112, 122 have been recognized as the dominant factors, with the dielectric loss characteristic 113, 123 contributing to a lesser degree. In such cases, the lid 101 can be configured with a multiple dielectric layer 110, 120 stack-up with the right properties for a given frequency band.

In one aspect, absorption of RF energy by one or more of the dielectric layers 110, 120 can be due to matched impedance for a particular frequency range. In another aspect, RF energy can be attenuated by one or more of the dielectric layers 110, 120, which can be "lossy" absorbers or absorbing dielectric materials. As RF energy is reflected by the metal backing layer 140 the energy cancels itself out to some degree. The result is a stack-up of dielectric layers 110, 120, working in unison, with a metal backing layer 140 that can provide a good match to a microwave signal in a particular frequency or operating band that may impinge on the lid 101, such that the microwave signal is absorbed into the lid 101 and not reflected back to the circuit components 103, thereby reducing or eliminating resonances in the cavity 107 of the microwave module 100. In one aspect, the metal backing layer 140 can also serve to shield components external to the module 100 from RF energy originating within the module 100.

A properly "tuned" lid 101 can therefore appear as if it is not there, in that the negative aspects of a typical metal lid with regard to resonances and feedbacks in the cavity 107 are eliminated or minimized. A microwave module lid in accordance with the present disclosure may be particularly useful when the gain of a microwave module's RF amplifiers is very high because, in this case, only a small amount of feedback is needed to induce oscillations due to radiated RF energy looping back to the input of an amplifier. The lid 101 can therefore provide much greater module stability by effectively absorbing substantially all stray RF energy instead of partially absorbing and/or attenuating radiated RF energy, as with prior absorber coated metal lids.

The dielectric layers 110, 120 can include an absorbing or "high loss" material (i.e., ECCOSORB®) and/or a "low loss" material (i.e., ECCOSTOCK®) comprising an elastomer, polymer, composite, ceramic, etc. The dielectric layers 110, 120 can be of any suitable form or configuration, such as a foam, epoxy, coating, powder, sheet, adhesive, etc. In a particular example, a dielectric layer 110, 120 can comprise a polyurethane or silicone sheet loaded with iron particles. Still other configurations, forms and materials are contemplated, as will be recognized by those skilled in the art, with those described herein not intending to be limiting in any way.

In one aspect, one or more of the dielectric layers 110, 120 can be configured to form a primary structural support for the lid 101. For example, dielectric layer 120 can form the structural basis for the lid 101, in that side walls 108*a*, 108*b* of the lid 101 extend from the dielectric layer 120 and include interface features 109*a*, 109*b* to facilitate coupling the lid 101 to the substrate 102. This coupling can be done to seal the lid 101 to the substrate 102, such as with a hermetic seal, if desired. In addition, the dielectric layer 120 can be configured to provide support for the dielectric layer 110 and the metal backing layer 140. For example, as illustrated in FIG. 1, the "structural" dielectric layer 120 supports the metal backing layer 140 and the dielectric layer 110, which is proximate the metal backing layer 140, such that the dielectric layer 110 and the metal backing layer 140 are both "outside" the structural dielectric layer 120. Accordingly, the dielectric layer 120 can comprise a suitable structural material for the lid 101, such as a ceramic material. In one aspect, the dielectric layer 120 can comprise a high dielectric structural material, which can function to "squeeze" wavelengths down to provide a relatively thin dielectric layer. In another aspect, the structural dielectric layer 120 can define the inner side 106*a* of the lid 101, which can also partially define the cavity 107.

Figure 2:
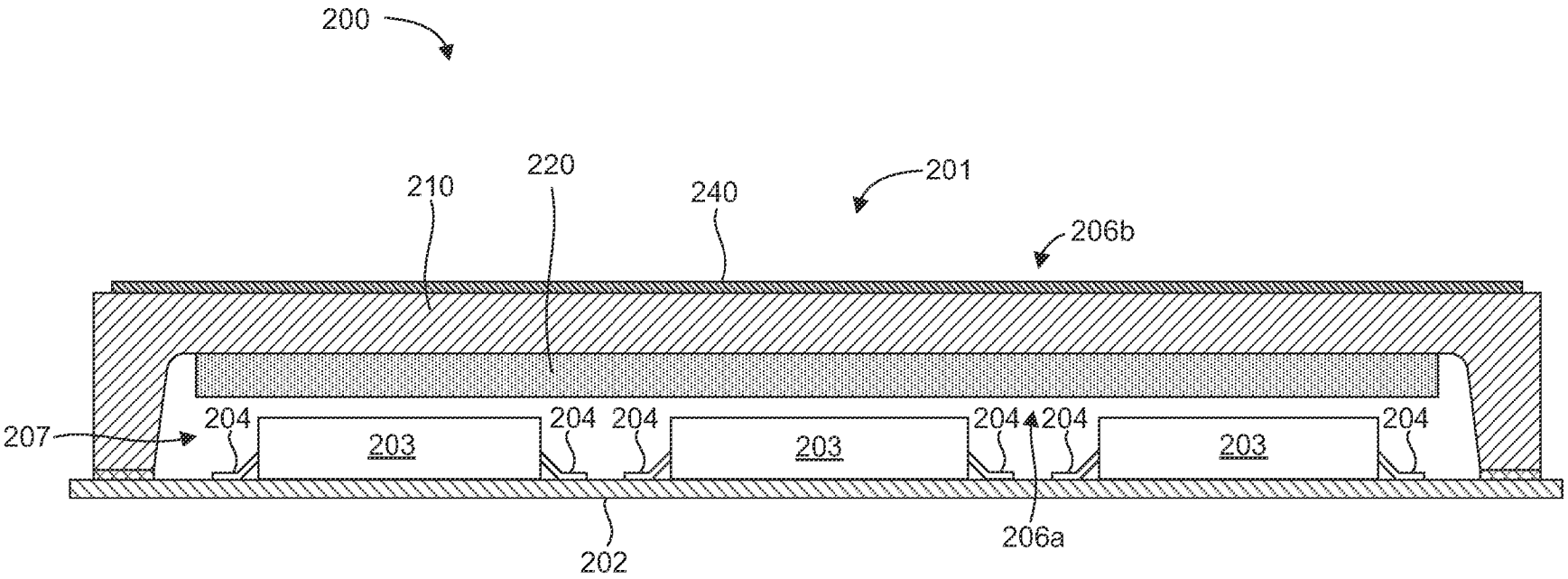
FIG. 2 is an example illustration of a microwave module in accordance with another example of the present disclosure.

FIG. 2 illustrates a microwave module 200, in accordance with another example of the present disclosure. The microwave module 200 is similar in many respects to the microwave module 100 of FIG. 1. For example, the microwave module 200 includes a lid 201 coupled to a substrate 202 that forms or defines a cavity 207 about circuit components 203 and wire bonds 204. The lid 201 also includes dielectric layers 210, 220 and a metal backing layer 240. In this case, the dielectric layer 210, which is proximate the metal backing layer 240, is configured to form a primary structural support for the lid 201 and therefore provides support for the dielectric layer 220 and the metal backing layer 240. Thus, as illustrated in FIG. 2, the "structural" dielectric layer 210 is between the dielectric layer 220 and the metal backing layer 240, with the dielectric layer 220 "inside" the structural dielectric layer 210 and the metal backing layer 240 "outside" the structural dielectric layer 210. In one aspect, the dielectric layer 220 primarily defines an inner side 206*a* of the lid 201, which can also partially define the cavity 207. In another aspect, the metal backing layer 240 can primarily define an outer side 206*b* of the lid 201.

Figure 3:
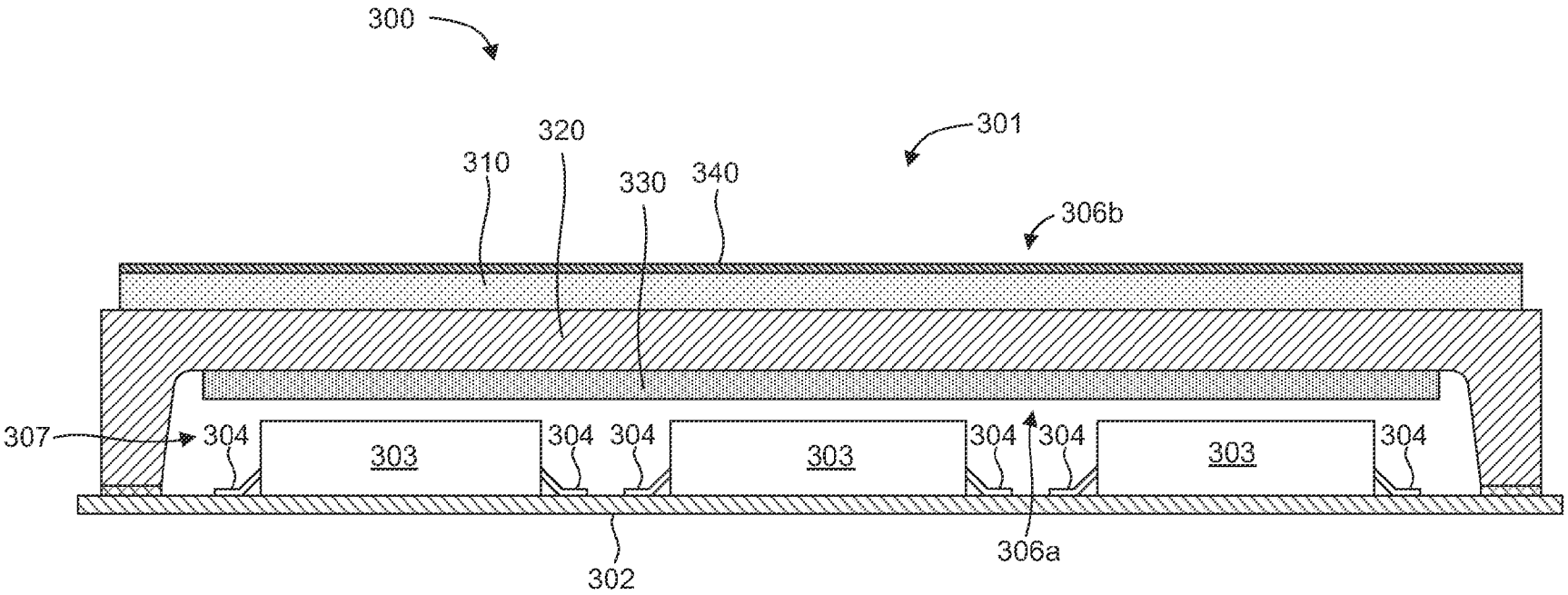
FIG. 3 is an example illustration of a microwave module in accordance with yet another example of the present disclosure.

FIG. 3 illustrates a microwave module 300, in accordance with yet another example of the present disclosure. The microwave module 300 is similar in many respects to the microwave modules 100 and 200 of FIGS. 1 and 2, respectively. For example, the microwave module 300 includes a lid 301 coupled to a substrate 302 that forms or defines a cavity 307 about circuit components 303 and wire bonds 304. The lid 301 also includes at least two dielectric layers 310, 320, 330 and a metal backing layer 340, where one of the dielectric layers (dielectric layer 320) is configured to form a primary structural support for the lid 301 and provide support for other dielectric layers (dielectric layers 310, 330) and the metal backing layer 340. In this case, an extra dielectric layer is provided in the lid 301 compared to the lids 101, 201 discussed above. The increased number of dielectric layers in the lid 301 improves the ability to tune the lid 301 compared to the lids 101, 201 because the variables associated with each layer, namely, thickness, dielectric constant, and dielectric loss characteristics, provide additional flexibility for tuning the lid 301 to perform at a desired frequency or frequency range. In one aspect, the increased number of dielectric layers of the lid 301 can be configured to provide greater absorbing capabilities over the lids 101, 201.

Thus, as illustrated in FIG. 3, the "structural" dielectric layer 320 is between the dielectric layers 310, 330, with the dielectric layer 330 "inside" the structural dielectric layer 320 and the dielectric layer 310 "outside" the structural dielectric layer 320. In other words, the dielectric layer 310 and the dielectric layer 330 are disposed on opposite sides of the structural dielectric layer 320. In one aspect, the dielectric layers 310, 330 can be relatively thin when compared to the structural dielectric layer 320. In addition, the metal backing layer 340 is disposed proximate the dielectric layer 310 "outside" the structural dielectric layer 320. In another aspect, the dielectric layer 330 primarily defines an inner side 306*a* of the lid 301, which can also partially define the cavity 307. In addition, the metal backing layer 340 can primarily define an outer side or surface 306*b* of the lid 301. In one example, the lid 301 can have a ceramic structural layer 320 bounded on opposite sides with dielectric layers 310, 330 comprising absorbing RF sheets, with a thin metal backing layer 340 proximate the dielectric layer 310 to form a reflecting plane.

Figure 4:
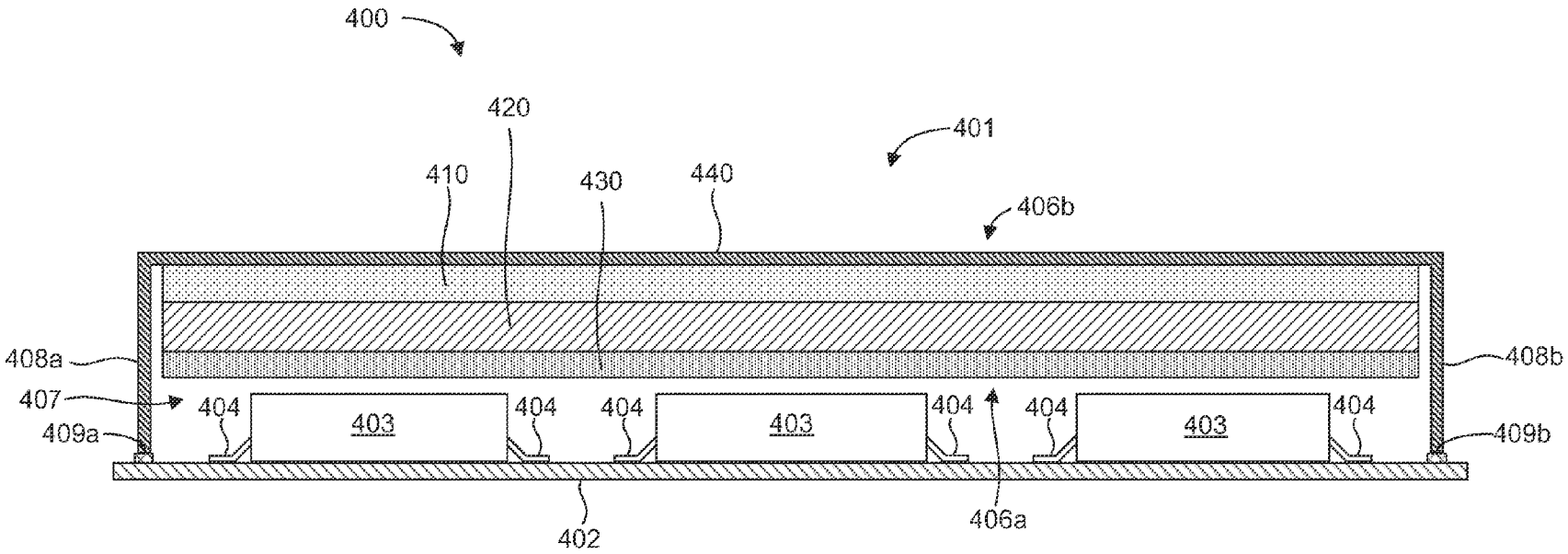
FIG. 4 is an example illustration of a microwave module in accordance with still another example of the present disclosure.

FIG. 4 illustrates a microwave module 400, in accordance with still another example of the present disclosure. The microwave module 400 is similar in many respects to the microwave modules disclosed hereinabove. For example, the microwave module 400 includes a lid 401 coupled to a substrate 402 that forms or defines a cavity 407 about circuit components 403 and wire bonds 404. The lid 401 also includes at least two dielectric layers 410, 420, 430 and a metal backing layer 440. In this case, the metal backing layer 440 is configured to form a primary structural support for the lid 401. For example, metal backing layer 440 can form the structural basis for the lid 401, in that side walls 408*a*, 408*b* of the lid 401 extend from the metal backing layer 440 and include interface features 409*a*, 409*b* to facilitate coupling the lid 401 to the substrate 402, such as with a hermetic seal, if desired (such as by welding). In addition, the metal backing layer 440 is configured to provide support for the dielectric layers 410, 420, 430. For example, as illustrated in FIG. 4, the "structural" metal backing layer 440 supports the dielectric layers 410, 420, 430, with the dielectric layer 410 being proximate the metal backing layer 440, such that the dielectric layers 410, 420, 430 are all "inside" the metal backing layer 440. This absorbent configuration within a metal "shell" may be particularly well-suited for containing electromagnetic radiation within the cavity 407 of the lid 401 so that there is no "cross-talk" or electromagnetic interference with other electronics that may be nearby.

Figure 5:
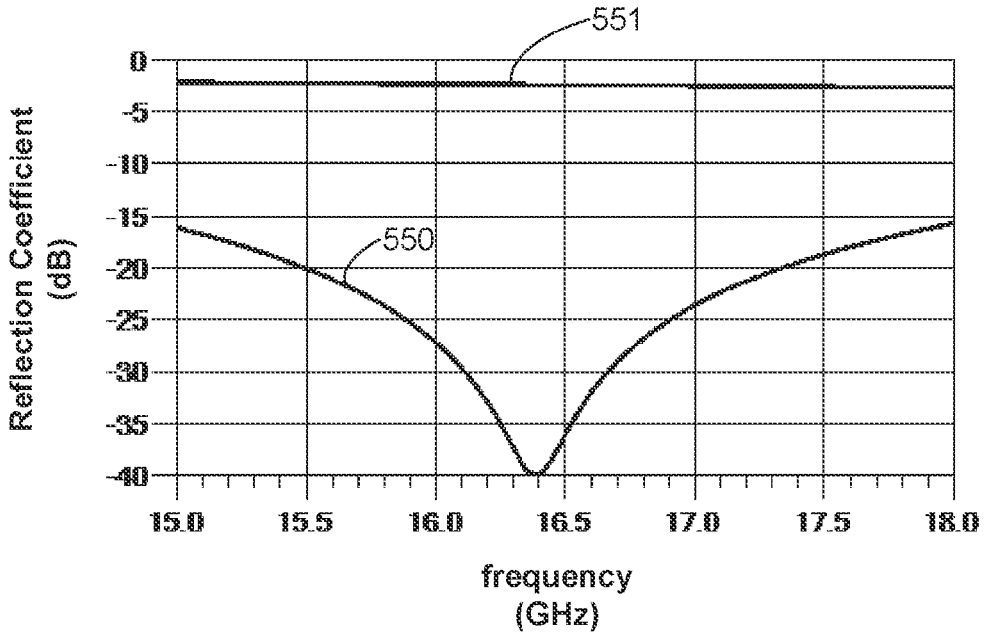
FIG. 5 illustrates absorbing performance of a lid in accordance with an example of the present disclosure and a typical absorber-loaded metal lid.

FIG. 5 illustrates an example absorbing performance of the lid 301 of FIG. 3 (identified by reference number 550) and a typical metal lid (identified by reference number 551) having an absorber disposed inside and bonded to a metal surface. Testing was performed on a compact Ku-band RF module with high gain (greater than 40 dB) and showed that oscillations were eliminated using the lid 301 configuration, while all experiments with an absorber-loaded metal lid resulted in oscillations. Simulations therefore showed significant improvement by the lid 301 configuration in isolation performance over a typical absorber-loaded metal lid. Thus, a lid in accordance with the present disclosure can greatly improve absorbing effectiveness.

In accordance with one embodiment of the present invention, a method for facilitating minimizing RF resonance in a cavity of a microwave module is disclosed. The method can comprise obtaining a microwave module lid, the lid having at least two dielectric layers proximate one another, each layer having a thickness, a dielectric constant, and a dielectric loss characteristic, and a metal backing layer proximate one of the dielectric layers to contain RF energy within the lid. Additionally, the method can comprise facilitating coupling of the microwave module lid to a substrate on which an RF emitting component is disposed, the microwave module lid and the substrate defining a cavity about the RF emitting component, wherein the thicknesses, the dielectric constants, the dielectric loss characteristics, or combinations thereof of the at least two dielectric layers are configured to minimize RF resonance in the cavity. It is noted that no specific order is required in this method, though generally in one embodiment, these method steps can be carried out sequentially.

In one aspect, at least one of the dielectric layers can be configured to form a primary structural support for the microwave module lid and include an interface feature to facilitate coupling the microwave module lid to the substrate. In another aspect, the metal backing layer can be configured to form a primary structural support for the microwave module lid and include an interface feature to facilitate coupling the microwave module lid to the substrate.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A microwave module lid, comprising:

an inner side operable to define, at least in part, a cavity configured to have a radio frequency (RF) emitting component disposed therein;

at least two dielectric layers differing in at least one property proximate one another, each layer having a thickness, a dielectric constant, and a dielectric loss characteristic; and a metal backing layer proximate one of the dielectric layers to contain RF energy within the microwave module lid, wherein the thicknesses, the dielectric constants, the dielectric loss characteristics, or combinations thereof of the at least two dielectric layers are configured to minimize RF resonance in the cavity.

2. The microwave module lid of claim 1, wherein at least one of the dielectric layers comprises a ceramic material.

3. The microwave module lid of claim 1, wherein at least one of the dielectric layers comprises an absorbing dielectric material.

4. The microwave module lid of claim 1, wherein at least one of the dielectric layers defines, at least in part, the inner side of the microwave module lid.

5. The microwave module lid of claim 1, wherein the metal backing layer defines, at least in part, an outer side of the microwave module lid.

6. The microwave module lid of claim 1, wherein at least one of the dielectric layers is configured to form a primary structural support for the microwave module lid.

7. The microwave module lid of claim 1, wherein the metal backing layer is configured to form a primary structural support for the microwave module lid.

8. The microwave module lid of claim 1, wherein the at least two dielectric layers comprises first, second, and third dielectric layers.

9. The microwave module lid of claim 8, wherein one of the first, second and third dielectric layers is configured to form a primary structural support for the microwave module lid.

10. The microwave module lid of claim 9, wherein the second dielectric layer is configured to form the primary structural support, such that the first dielectric layer and the third dielectric layer are disposed on opposite sides of the second dielectric layer, and the metal backing layer is disposed proximate the third dielectric layer.

11. The microwave module lid of claim 8, wherein the metal backing layer is configured to form a primary structural support for the microwave module lid.

12. A microwave module, comprising:

a substrate;

a radio frequency (RF) emitting component disposed on the substrate; and a lid coupled to the substrate and having an inner side operable with the substrate to define a cavity about the RF emitting component, at least two dielectric layers differing in at least one property proximate one another, each layer having a thickness, a dielectric constant, and a dielectric loss characteristic, and a metal backing layer proximate one of the dielectric layers to contain RF energy within the lid, wherein the thicknesses, the dielectric constants, the dielectric loss characteristics, or combinations thereof of the at least two dielectric layers are configured to minimize RF resonance in the cavity.

13. The microwave module of claim 12, wherein at least one of the dielectric layers is configured to form a primary structural support for the lid and includes an interface feature to facilitate coupling the lid to the substrate.

14. The microwave module of claim 13, wherein the at least one of the dielectric layers configured to form the primary structural support comprises a ceramic material.

15. The microwave module of claim 12, wherein the metal backing layer is configured to form a primary structural support for the lid and includes an interface feature to facilitate coupling the lid to the substrate.

16. The microwave module of claim 12, wherein the coupling of the lid and the substrate forms a hermetic seal about the cavity.

17. The microwave module of claim 12, wherein the RF emitting component comprises a monolithic microwave integrated circuit.

18. A method for facilitating minimizing radio frequency (RF) resonance in a cavity of a microwave module, the method comprising:

obtaining a microwave module lid, the lid having at least two dielectric layers differing in at least one property proximate one another, each layer having a thickness, a dielectric constant, and a dielectric loss characteristic, and a metal backing layer proximate one of the dielectric layers to contain RF energy within the lid; and facilitating coupling of the microwave module lid to a substrate on which an RF emitting component is disposed, the microwave module lid and the substrate defining a cavity about the RF emitting component, wherein the thicknesses, the dielectric constants, the dielectric loss characteristics, or combinations thereof of the at least two dielectric layers are configured to minimize RF resonance in the cavity.

19. The method of claim 18, wherein at least one of the dielectric layers is configured to form a primary structural support for the microwave module lid and include an interface feature to facilitate coupling the microwave module lid to the substrate.

20. The method of claim 18, wherein the metal backing layer is configured to form a primary structural support for the microwave module lid and include an interface feature to facilitate coupling the microwave module lid to the substrate.

* * * * *